US005283595A

United States Patent [19]

Krukovsky

[11] Patent Number: 5,283,595

[45] Date of Patent: Feb. 1, 1994

[54] VISUAL PAGING SYSTEM

[76] Inventor: Yuri Krukovsky, 43 St. Mark's Place, #6D, New York City, N.Y. 10003

[21] Appl. No.: 822,606

[22] Filed: Jan. 17, 1992

[51] Int. Cl.[5] ..... G09G 5/14

[52] U.S. Cl. ..... 345/2; 40/606

[58] Field of Search ..... 340/815.01, 815.15, 340/711, 793; 40/606, 607, 447, 448, 450, 463; 235/431; 368/10

[56] References Cited

U.S. PATENT DOCUMENTS

| | | | |
|---|---|---|---|
| 2,795,853 | 6/1957 | Benfield | 40/446 |
| 4,021,946 | 5/1977 | Bradshaw | 40/473 |
| 4,071,740 | 1/1978 | Grogolski | 235/431 |
| 4,162,610 | 7/1979 | Levine | 368/10 |
| 4,194,833 | 3/1980 | Lester et al. | 340/793 |
| 4,329,800 | 5/1982 | Shuman | 40/606 |
| 4,405,984 | 9/1983 | Siegel et al. | 346/711 |
| 4,430,639 | 2/1984 | Bennett | 340/711 |
| 4,738,042 | 4/1988 | Corder et al. | 40/472 |
| 4,777,751 | 10/1988 | Pasquale | 40/610 |
| 4,888,709 | 12/1989 | Revesz et al. | 340/825.15 |
| 4,926,326 | 5/1990 | McKinley | 340/717 |
| 4,974,354 | 12/1990 | Hembrook, Jr. | 40/546 |
| 5,160,919 | 11/1992 | Mohler et al. | 340/711 |

FOREIGN PATENT DOCUMENTS

| | | |
|---|---|---|
| 3513557 | 10/1986 | Fed. Rep. of Germany . |
| 2086688 | 5/1982 | United Kingdom . |
| 2212965 | 8/1989 | United Kingdom . |

*Primary Examiner*—Ulysses Weldon
*Assistant Examiner*—Gin Goon
*Attorney, Agent, or Firm*—Robert W. J. Usher

[57] ABSTRACT

A visual paging device comprises a LED or LCD screen for displaying a personal message which can be input by the user through a keyboard on the device itself or through a computer at a rental location to which the device can be releasibly connected or, by an infrared remote keyboard. A stand supports the screen on a wheeled base for easy transportation from the rental location to a meeting area and is adjustable in height enabling the message to be displayed above a crowd.

14 Claims, 3 Drawing Sheets

VISUAL PAGING SYSTEM

FIELD OF THE INVENTION

The invention relates to a visual paging system for displaying electronically generated personal messages on portable display devices and to portable, electronic personal message display devices for use, particularly, in paging individuals at airports, conference halls and other mass meeting places.

BACKGROUND OF THE INVENTION

Various types of devices for displaying differing identifying information are known, for example, U.S. Pat. No. 4,929,936 issued May 29, 1990 to Friedman et al teaches one such device which includes a display panel with illuminated numbers which can be selectively programmed by a user to identify the street number of a residence. However, such device is constructed specifically for mounting on the wall of the residence.

Another type of device is taught by U.S. Pat. No. 4,904,997 issued Feb. 27, 1990 to Chen et al, which device is attached to an arm of a patient for temperature measurement which is displayed on an LCD screen.

In addition, a variety of programmable electronic message signs are currently commercially available. They are used for advertising and information in stores, banks, offices, airports etc.

However, none of these devices are suitable for visually paging individuals arriving at crowded mass meeting places because of specific design or their bulky construction.

Traditional approaches to paging arriving visitors have been by holding hand-written signs carrying the messages concerning the name of the individual or contact overhead, above the crowd. However, this is extremely laborious and requires the person meeting the arriving visitor to remain at the arrival point for a long period of time, possibly taking several hours when delays are experienced for example in customs when the arrivals area is extremely crowded. Furthermore, the contact cannot leave the area for even only a very short time as there is a real risk of missing the visitor.

SUMMARY OF THE INVENTION

An object of the present invention is to provide a visual paging device providing a personal identifying message on an electronic display which makes the meeting procedure less laborious and more reliable.

Another object of the present invention is to provide an electronic display device, which can easily be transported, e.g., carried by an individual user from a rental location to the meeting place, left at the meeting place and readily spotted by a person in the crowd.

A further object of the present invention is to provide an electronic display device which can be simply adapted to existing computer systems at a rental location for displaying messages programmed by the computer system thereon.

Yet another object of the present invention is to provide an electronic display device which permits the individual user himself to program his own message to be displayed, either by using a keyboard provided on the device or by wireless control means.

According to one aspect of the invention there is provided a visual paging system comprising a processor at a central location programmable to provide a source of different message data signals and a plurality of portable, electronic personal message display devices each comprising: display means for visual presentation of a programmed personal message; means for releasably connecting the display device to the processor for receiving a selected input message data signal from the source; data converting means connected between the input data connecting means and the display means for converting the input data signal for operating the display means; and, stand means for mounting said display means at an elevated position remote from the central location whereby a personal message displayed on the display means can be readily spotted by a person in a crowded area.

Preferably, the stand means includes a base provided with rolling means enabling an individual user to move the device to any convenient location.

Desirably, the stand means comprises a base, a hollow post upstanding from the base and a display means supporting rod telescopically received within said hollow post and means for securing the rod to the post in different vertical positions of telescopic adjustment to adjust the height of the display means.

According to another aspect of the invention, there is provided a visual paging system comprising wireless control means programmable to transmit different message data signals and a plurality of portable, electronic personal message display devices each comprising: display means for visual presentation of a programmed personal message; signal receiving means for receiving a selected signal transmitted by said control means; data converting means connected between the signal receiving means and the display means for converting the received signal to operate the display means; and, stand means for mounting said display means at an elevated position remote from the central location whereby a personal message displayed on the display means can be readily spotted by a person in a crowded area.

According to an additional aspect of the invention there is provided a portable, electronic, personal message display device comprising: display means for visual presentation of a programmed personal message; input data connecting means for connection to a source of an input data signal; data converting means connected between the input data connecting means and the display means for converting the input data signal to operate the display means; and, stand means for mounting said display means at an elevated position whereby a personal message displayed on the display means can be readily spotted by a person in a crowded area.

According to a further aspect of the invention there is provided a portable, electronic, personal message display device comprising: display means for visual presentation of a programmed personal message; input data means programmable by the individual user for providing the input data signal source; data converting means connected between the input data means and the display means for converting the input data signal to operate the display means; and stand means for mounting said display means at an elevated position whereby a personal message displayed on the display means can be readily spotted by a person in a crowded area.

The invention affords the possibility of individuals leasing the portable devices from rental locations when arriving at the airport, having such devices plugged into the computer at the rental location, for example, an information desk office, programmed to display any desired message identifying the contact or the visitor, for example, or, alternatively, to program the input message themselves by either using the keyboard of the device provided, for example, on a reverse side of the display screen of the display means or the remote control keyboard.

The individual device can then easily be carried or rolled to the arrivals area, the height of the display screen adjusted and located in any convenient place where the elevated display screen can be readily spotted by the arriving visitor.

Thus, the invention obviates the disadvantages of preparing and holding a hand-written sign overhead for long periods of time, while it is possible to leave the arrivals or waiting area for some time without risk of missing an arriving visitor.

The procedure is relatively simple to follow and the individual display devices of simple construction utilizing an LED or LCD display panel which is widely used for electronic information signs.

It will be appreciated that the message displayed may be quite short so the display panel or screen may require only one or two lines. Furthermore, a moving message mode can be utilized to provide longer messages, the pre-programmed message moving across the display panel from right to left.

Battery drain can be reduced by operating the display in an intermittent mode in which the message appears on the display periodically, which can also be more conspicuous.

Where the message is programmed by the user, a keyboard or any other suitable input means such as a touch entry or pen entry device can be incorporated, for example, on a reverse side of the display screen housing, permitting the individual user simply to program the desired message.

In this case these electronic displays can be already located adjacent arrival gates, each device having a different designated number and special ID code. An ID code can be provided to the individual user at the rental location, for example at the information desk office, thus enabling the user to commence programming or to activate the display means.

In addition, the device can be coin operated with a coin receptacle incorporated, for example, in the base of the stand, limiting use of the display device to a definite period.

Where the input message is programmed without using a computer system at a central location, an infrared remote control keyboard can be utilized and an infrared signal receiver can be mounted on the display means of the device.

In the most simple version of the device, the programming occurs centrally in the computer at the rental location, for example, the information desk office, by the clerk and the individual display device can simply be plugged into the computer to receive a message programming signal therefrom.

BRIEF DESCRIPTION OF THE DRAWINGS

Embodiments of the invention will now be described by way of example only and with reference to the accompanying drawings in which.

DETAILED DESCRIPTION

Figure 1:
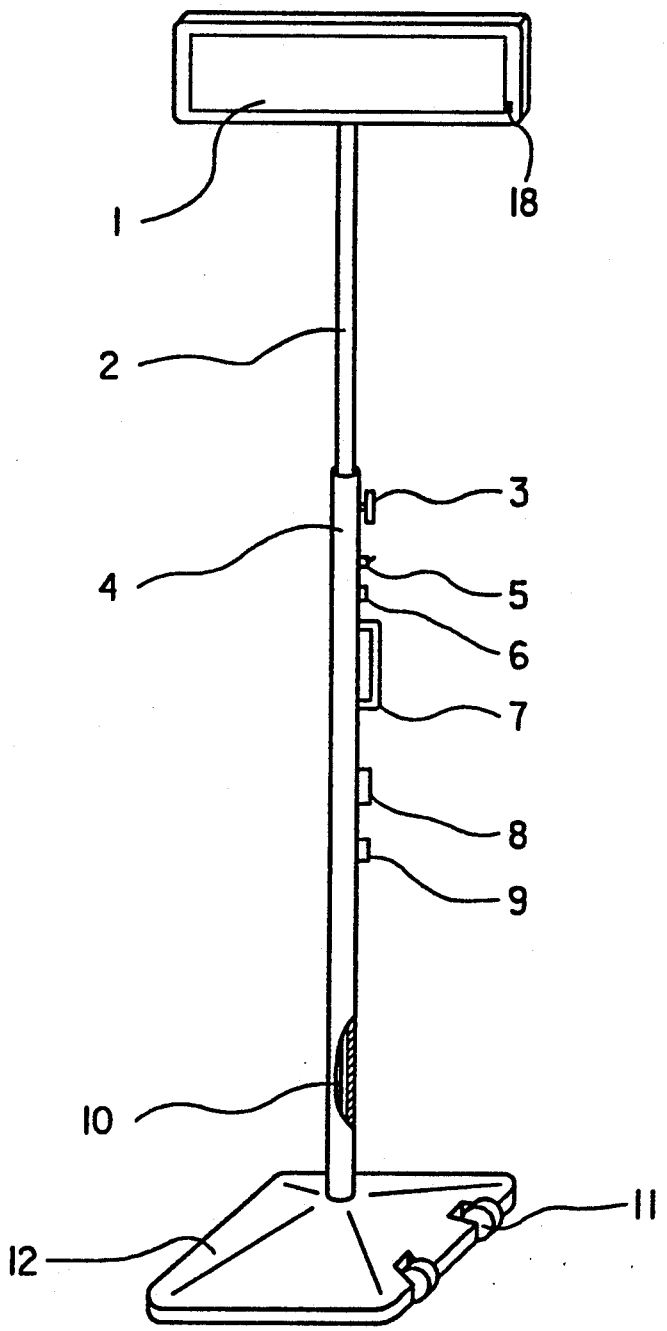
FIG. 1 is a perspective view of an individual visual paging or electronic, personal message display device.

As shown in FIG. 1, the visual paging device comprises an electronic display panel or screen 1 mounted on a rectangular base 12 by a hollow post 4 telescopically receiving a hollow supporting rod or arm 2 securable in different positions of vertical adjustment by manually operated screw 3, provided on the post 4. A handle 7 is also provided on the post to facilitate movement of the device by carrying or dragging on wheels 11, provided on one side of the base 12, from a rental location to a meeting area such as an arrivals area at an airport.

To improve stability and facilitate movement, a panel of the device needs only accommodate electronic components (for example LED) required for the visual presentation of information while the remaining electronic circuitry and power supply (battery) 15 is incorporated in the housing of the base 12.

The independent power supply unit 15 is a rechargeable battery which can be connected to an external source of DC by a power supply adaptor 9 mounted on the post. An input message data connector 8 is provided on the post for receipt of an input message data signal from an external source such as a previously existing computer at the rental location.

The electrical connection between the display panel, on-off switch 5, a display means operating (on/off) button 6, input data connector 8, power supply adaptor 9 and the battery 15 is effected by a cable 10 extending axially within the post 4 and the rod 2.

Figure 2:
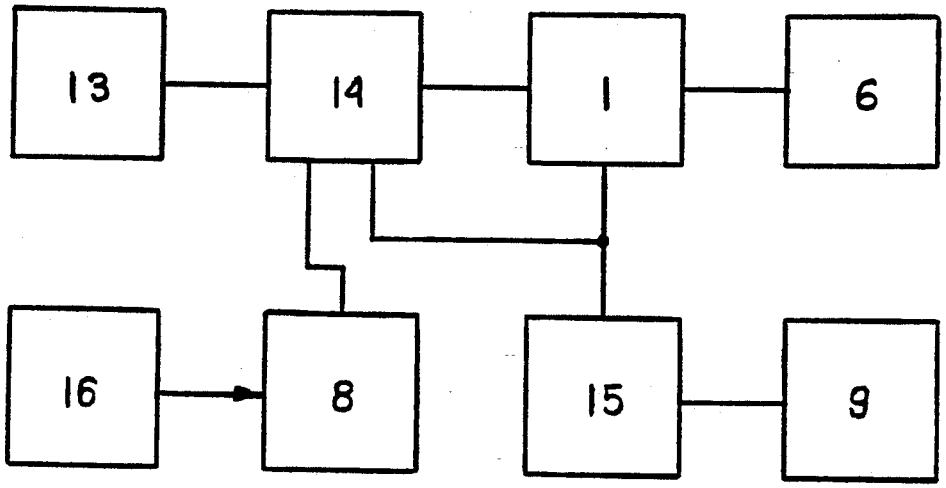
FIG. 2 is a block circuit diagram of an electronic display means of the device of FIG. 1.

As shown schematically in FIG. 2, during the programming step, a chosen message input means 13 enters message data into data converting means 14 where it is operated on to generate transformed data compatible with the display means 1.

Figure 4:
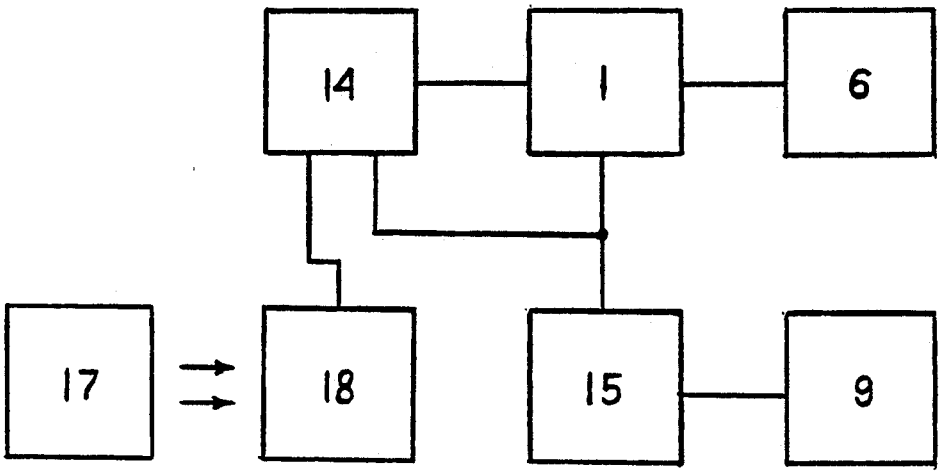

In one version of the invention, the electronic display does not include built-in input means 13, desired personal message input data being entered in the electronic display, for example, by a keyboard of an existing computer system 16 at the rental location, (for example, an information desk office) by connection to the input data connector 8. As shown in FIG. 4, where the message signal is transmitted to the electronic display by a remote controller, infrared remote control keyboard 17 is used as a remote control input means, instead of the input data connector 8. An infrared signal can then be received by infrared sensor 18 and fed to the data converting means 14.

In this case, the visual paging system of the present invention does not require the computer system at the central location. Subsequently, the device can be moved by the individual user to a suitable location in the waiting area where the visual presentation of the programmed message on the display means 1 can be activated by the user using the button 6.

Figure 3:
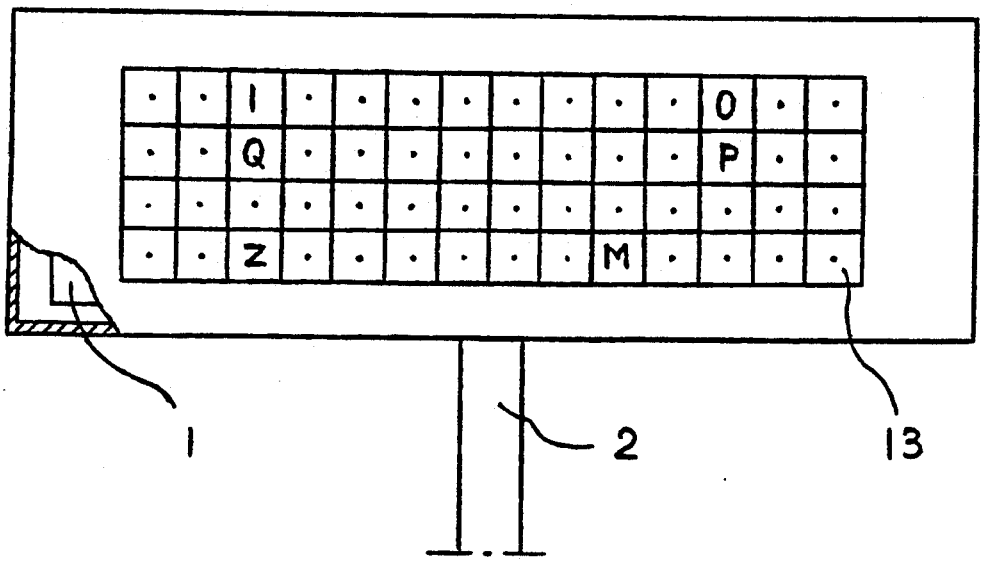
FIG. 3 is a schematic view of a reverse side of the display panel with an input data keyboard mounted thereon; and, FIG. 4 is a block circuit diagram of an electronic display means of the device using remote control input means.

In an alternative version of the invention which allows a user himself to program a desired message, the input means 13 can be mounted on the back of a panel of the display means 1 (see FIG. 3). The input means can be lightweight keyboard, touch entry or pen entry devices etc.

The display screen can be built with LED 5×7 dot-matrix displays, which can be stacked horizontally to create a string of a desirable number of character positions. At present such displays are commonly used on electronic signs in view of LED reliability and good light emitting and power consumption characteristics.

Conventional electronic displays can easily be implemented because LED matrices, the main component, are commonly sold as complete assemblies with built-in drive electronics, which may be connected directly to a source of ASCII signals, for example, to any existing computer system. The character set for the 5×7 matrix which is stored in ROM of the character generator of the built-in drive electronics, can be extensive and capable of displaying upper and lower cast text, number, punctuation, some elementary mathematical symbols and different language characters. These assemblies may be obtained in packages containing up to 16 character positions from such manufacturers as Hewlett Packard Optoelectronics Division, General Instrument Corporation Optoelectronics Division, Data Display Products and others.

Thus, the visual paging devices may utilize proven mass produced components assuring reliability and economy of high volume manufacture.

Built-in or infrared remote control keyboards can be obtained from such manufactures as Pro-Lite Inc., Hi-Lite, Text-Lite and others. For example, infrared remote control keyboards with infrared transmitter/-receiver systems can be obtained from Pro-Lite Inc., of California. Such systems are used in the company's electronic signs designated PL-4012, PL-2020 and others.

I claim:

1. A visual paging system which enables an individual user to display personal messages at different locations of a mass meeting area to individual persons at those different locations comprising a processor at a central location programmable to provide a source to different message data signals and a plurality of independent portable, electronic, personal message display devices between the central location and locations in the meeting area and each comprising:

electronic display means for visual presentation of a programmed personal message;

stand means including a hollow base and a supporting hollow post upstanding therefrom for mounting said electronic display means at an elevated position at a location in a mass meeting area remote from the central location whereby a personal message displayed on the electronic display means can be readily spotted by a person in a crowd;

a pluggable connector mounted on one of the stand and display means for releasably connecting the display device to the processor for receiving a selected input message data signal from the source at the central location;

data converting means connected between the pluggable connector and the electronic display means for converting the input data signal for operating the electronic display means;

independent power supply means in the hollow base for energizing the electronic display means;

electrical cable means extending inside the hollow post and interconnecting the independent power supply means and the display means; and, switching means for operation of the display means.

2. A visual paging system according to claim 1 in which rolling means is provided on the base enabling a user to move the device to any convenient location.

3. A visual paging display system according to claim 1 in which a display means supporting rod is telescopically received within said hollow post and means are provided for securing the rod to the post in different vertical positions of telescopic adjustment to adjust the height of the display means.

4. A visual paging system which enables an individual user to display personal messages at different locations of a mass meeting area to individual persons at those different locations comprising wireless control means programmable to transmit different message data signals and a plurality of independent portable, electronic personal message display devices movable between locations in the meeting area and each comprising:

electronic display means for visual presentation of a programmed personal message;

stand means including a hollow base and a supporting hollow post upstanding therefrom for mounting said electronic display means at an elevated position at a location in a mass meeting area remote from the central location whereby a personal message displayed on the electronic display means can be readily spotted by a person in a crowd;

signal receiving means for receiving a selected signal transmitted by said control means;

data converting means connected between the signal receiving means and the electronic display means for converting the received signal to operate the electronic display means;

independent power supply mans in the hollow base for energizing the electronic display means;

electrical cable means extending inside the hollow post and interconnecting the independent power supply means and the display means; and, switching means for operation of the display means.

5. A portable, electronic, personal message display device for movement between different locations of a mass meeting area to display personal messages to individual persons at those different locations comprising:

electronic display means for visual presentation of a programmed personal message;

a single post-form stand including a hollow base and a supporting hollow post upstanding therefrom for mounting said electronic display means at an elevated position at a location in a mass meeting area remote from the central location whereby a personal message displayed on the electronic display means can be readily spotted by a person in a crowd;

a pluggable connector mounted on one of the stand and display means for connection to a source of an input data signal;

data converting means connected between the pluggable connector and the electronic display means for converting the input data signal to operate the electronic display means;

independent power supply means in the hollow base for energizing the electronic display means;

electrical cable means extending inside the hollow post and interconnecting the independent power supply means and the display means; and, switching means for operation of the display means.

6. A device according to claim 5 in which rolling means is provided on the base enabling a user to move the device to any convenient location.

7. A device according to claim 5 wherein an electronic display means supporting rod is telescopically received within said hollow post and means are provided for securing the rod to the post in different vertical positions of telescopic adjustment to adjust the height of the display means.

8. A portable, electronic, personal message display device for movement between different locations of a mass meeting area to display personal messages to individual persons at those different locations comprising:

electronic display means for visual presentation of a programmed personal message;

a single post-form stand means including a hollow base and a supporting hollow post upstanding therefrom for mounting said electronic display means at an elevated position at a location in a mass meeting area remote from the central location whereby a personal message displayed on the electronic display means can be readily spotted by a person in a crowd;

input data means programmable by the individual user for providing an input data signal source;

data converting means connected between the input data means and the electronic display means for converting the input data signal to operate the electronic display means;

independent power supply means in the hollow base for energizing the electronic display means;

electrical cable means extending inside the hollow post and interconnecting the independent power supply means and the display means; and, switching means for operation of the display means.

9. A portable, electronic, personal message display device for movement between different locations of a mass meeting area to display personal messages to individual persona at those different locations comprising:

electronic display means for visual presentation of a programmed personal message;

a single post-form stand including a hollow base and an supporting hollow post upstanding therefrom for mounting said electronic display means at an elevated position at a location in a mass meeting area remote from the central location whereby a personal message displayed on the electronic display means can be readily spotted by a person in a crowd;

signal receiving means for receiving a selected signal transmitted by a remote wireless control means;

data converting means connected between the signal receiving means and the electronic display means for converting the received signal to operate the electronic display means;

independent power supply means in the hollow base for energizing the electronic display means;

electrical cable means extending inside the hollow post and interconnecting the independent power supply means and the display means; and, switching means for operation of the display means.

10. A visual paging display system according to claim 3 in which the device further includes a power supply adaptor.

11. A device according to claim 8 in which the electronic display means include a screen on a front side thereof and the input data means is a keyboard mounted on a rear side thereof.

12. A visual paging display system according to claim 10 further comprising a carrying handle attached to the post means.

13. A visual paging display system according to claim 10 in which the base is bounded by a plurality of straight sides and the rolling means is constituted by a pair of rollers mounted in spaced apart relation on only one of the sides.

14. A visual paging display system according to claim 1 in which the pluggable connector is mounted on the post.

* * * * *